US005776257A

United States Patent [19]

Arnold et al.

[11] Patent Number: 5,776,257

[45] Date of Patent: Jul. 7, 1998

[54] GAS TIGHT TANK CLEANING METHOD

[75] Inventors: Kermit R. Arnold, Bacliff; Craig Jeffrey Byard, League City, both of Tex.

[73] Assignee: Landry Service Co. Inc., Bacliff, Tex.

[21] Appl. No.: 916,380

[22] Filed: Aug. 22, 1997

Related U.S. Application Data

[63] Continuation-in-part of Ser. No. 677,389, Jul. 9, 1996.

[51] Int. Cl.[6] ..... B08B 9/08

[52] U.S. Cl. ..... 134/11; 134/21; 134/22.1

[58] Field of Search ..... 134/10, 21, 11, 134/22.1, 40, 111, 109, 166 R, 169 R, 167 R, 172, 181, 198

[56] References Cited

U.S. PATENT DOCUMENTS

| | | | |
|---|---|---|---|
| 3,042,553 | 7/1962 | Kearney et al. | 134/11 |
| 3,046,163 | 7/1962 | Kearney et al. | 134/11 |
| 4,770,711 | 9/1988 | Deal, III et al. | 134/22.12 |
| 5,041,165 | 8/1991 | Urbani | 134/22.18 |
| 5,091,016 | 2/1992 | Krajicek et al. | 134/22.12 |
| 5,409,025 | 4/1995 | Semler et al. | 134/166 R |
| 5,591,272 | 1/1997 | Hummer | 134/22.12 |
| 5,640,982 | 6/1997 | Landry et al. | 134/167 R |

FOREIGN PATENT DOCUMENTS

| | | | |
|---|---|---|---|
| 6-126262 | 5/1994 | Japan | 134/22.18 |

*Primary Examiner*—Frankie L. Stinson
*Attorney, Agent, or Firm*—William J. Beard

[57] ABSTRACT

Methods for cleaning industrial tanks are disclosed in which a fast temporary seal is applied to a manway entry into a tank to be cleaned. A robotic tank cleaning system is introduced through the temporary seal into the tank. The tank interior is sprayed with diluent to remove liquid and solid volatile organic compound (VOC) generating residue. VOC's are removed from the tank by repetitive diesel and water/surfactant fogging until a safe, legal level of VOC's remains in the tank atmosphere.

8 Claims, 6 Drawing Sheets

GAS TIGHT TANK CLEANING METHOD

This application is a Continuation-In-part of Copending application Ser. No. 08/677,389 filed Jul. 9, 1996 still pending.

BACKGROUND OF THE INVENTION

This invention relates to the cleaning of storage tanks used in petrochemical plants or oil refineries, and more particularly, to systems for removing waste materials which accumulate over time in such tanks.

In the petroleum refining and petrochemical chemical industries large storage tanks are in common usage. Various processes cause waste materials, both solid and liquid, to be generated along with the desired products. The accumulation of such waste materials, or sludge, can occur in these large storage tanks. It is not uncommon to have several feet of such sludge in the bottom of a single such large storage tank. The sludge separated from the solid irreducible waste which may compromise catalyst fines, rust or other particulate matter developed in a particular chemical process.

In the prior art, heated diluent such as diesel fuel or light crude oil or water is directed by hand held hose inside a storage tank against the sludge therein. This can convert the sludge into a pumpable slurry which is then pumped from the tank and further treated to separate out reusable hydrocarbons and recycle the diluent while discarding the solid waste. It was also proposed in U.S. Pat. No. 4,817,653 to use a waste washing robot operated by a human operator positioned inside the tank to spray water under pressure against tank residue to cause dislodgment of the sludge or other waste. In copending U.S. application Ser. No. 08/634,147, now issued U.S. Pat. No. 5,642,745 a dual tracked remotely operated robotic vehicle is used to travel about inside a large tank to be cleaned. Such a vehicle, however, requires human entry in o the tank for its assembly and deployment. This risks human exposure to chemicals and also could vent undesirable chemicals to outside air.

In practicing such prior art, techniques it has often been necessary to have an observer in line of sight of the point of application of the water or heated diluent order to cleaned. Workers can thus be exposed to $H_2S$, benzene or other potentially poisonous or highly volatile atmospheres. In the present invention this potentially dangerous exposure is eliminated through the use of robotic, remote controlled devices operable from a safer distance from the tank. These devices may be placed inside the tank by entry through a small manway or port and do not require interior human entry for their operation.

The present invention includes a gas tight cleaning system. This system cleans and degasses above ground storage tanks without manned entry. The system of the present invention is ideal for tanks with hazardous materials and applications where volatile organic compound (VOC) emissions must be controlled for regulatory compliance.

SUMMARY OF INVENTION

In the system of the present invention water or heated diluent is directed against tank sludge inside a tank being cleaned by a manway mounted robotic nozzle or cannon system. A lighting system and video camera on this robotic cannon system enable an operating technician located a safe distance away in a comfortable climate controlled portable building to operate the robotic nozzle or cannon, to direct the nozzle for a diluent or water, to the proper operating angle or position against the sludge, to operate an evacuation nozzle situated in the tank to pump out slurry created by the heated diluent or water, and to monitor $H_2S$, $O_2$ and LEL (LOWER EXPLOSIVE LIMIT) levels inside the tank. A microphone for audio monitoring may also be included in the robotic cannon system if desired. The robotic cannon system in hydraulically powered via an umbilical cable/hose system. A constant ground fault interrupter switch on the control unit alerts the operator if static dissipation grounding is lost. The cannon system may be suspended from a roof entry manway or may be cantilevered from a said entry manway port into the tank to be cleaned. Positioning and movement of the robotic cannon or nozzle within the tank is accomplished by the operator observing a video monitor connected to the video aligned with the cannon axis. The slurry produced by the application of the diluent, or water, is pumped via the evacuation nozzle from the tank and can be treated for separation of solids and hydrocarbons.

The structure and operation of the present invention is best understood by reference to the following detailed description thereof, which is intended as illustrative rather than limitative, when taken in conjunction with the accompanying drawings.

DETAILED DESCRIPTION OF THE PREFERRED EMBODIMENT OF THE INVENTION

Figure 1:
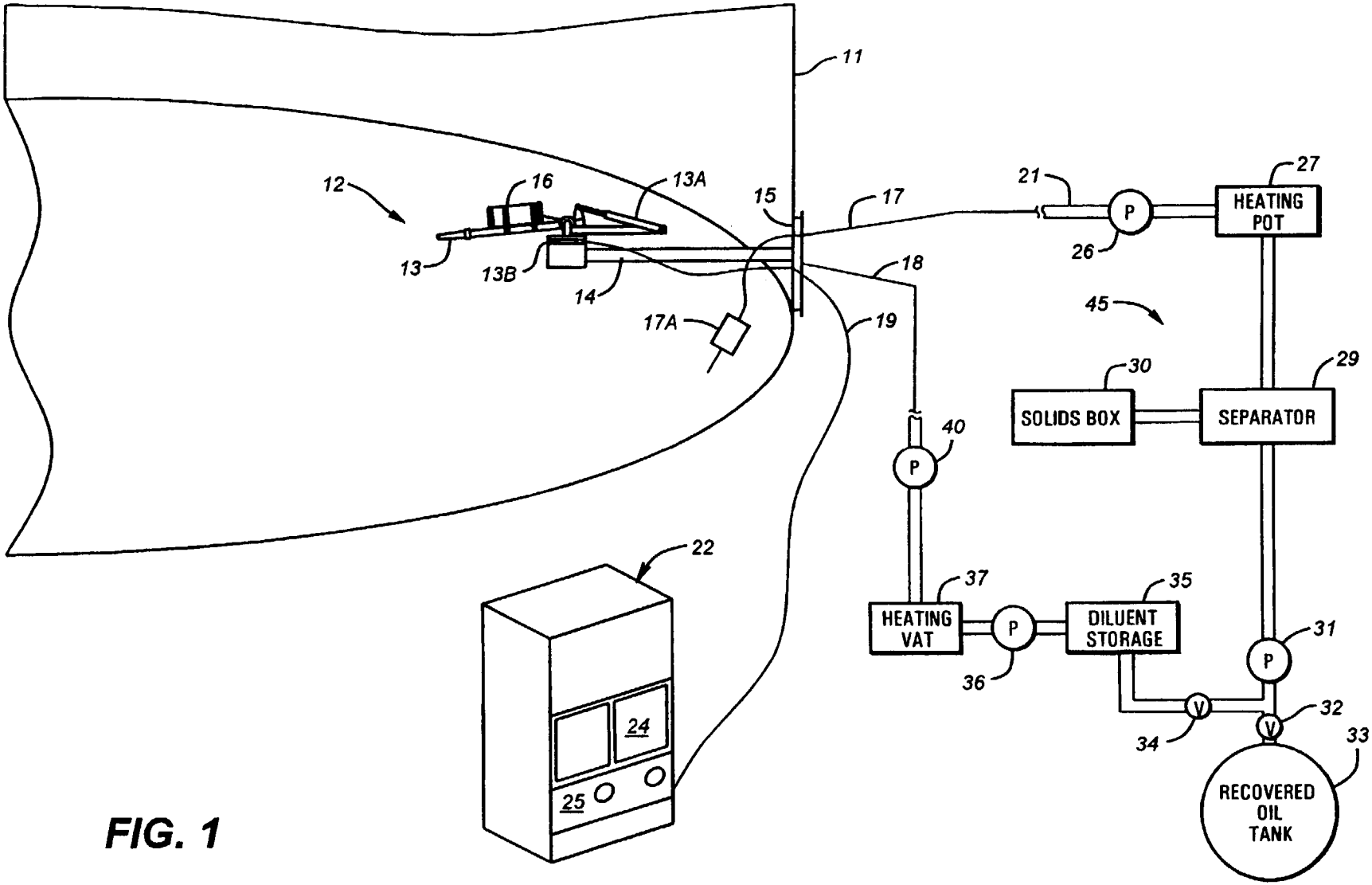
FIG. 1 is a schematic drawing showing an overall system according to concepts of the present invention deployed in tank to be cleaned using heated diluent and schematically showing the exterior processing of the pumpable slurry.

Referring initially to FIG. 1 a tank cleaning system employing generally the concepts of the present invention is shown schematically. A remote controlled robotic cannon nozzle system shown generally at 12, is deployed inside a tank 11 to be cleaned. The system 12 is attached to a remotely located control console 22 via an umbilical hose/cable system 17, 18, 19 to diluent delivery hose 41, and via an evacuation hose 21, to a slurry processing system shown generally at 45. While illustrated here using a heated diluent cleaning system recirculating the diluent, it will be understood that it may, be desirable to use pressurized water in some instances. The use of either and the use of other separation and recirculation systems is contemplated to be within the scope of the invention.

A cannon nozzle 13 which is movable in two axes via power of pair of hydraulic actuators 13A and 13B is attached via a cantilever beam 14 to a manway cover 15. A video camera and light source 16 are attached to the nozzle 13 so that video signals therefrom may be monitored at the control console video monitor screen 24 via the umbilical cable/hose 17, 18, 19. This control console 22 is provided with a control panel 25 which contains appropriate controls and switches, which will be discussed in more detail later, for controlling the movement of the cannon nozzle 13 and camera 16 and light source apparatus from a safe, controlled environment, remote location while the system is deployed in the tank to be cleaned.

Heated diluent is supplied via supply hose 41 to the cannon nozzle 13 of the system 12 where it is directed under the remote control (via console 22) of an operator against sludge to be removed from the tank 11. A pumpable slurry of solid and liquid including hydrocarbon is formed thereby. This slurry is pumped via an evacuation nozzle 17A, evacuation hose 21 and pump 26 to a heating pot 27. Heating pot 27 maintains the pumpability of the slurry which is usually pumped to a location somewhat removed from the tank 11 for further treatment. A separator 29 may comprise, for example, inclined shaker screens to separate out relatively large solid particles and/or a centrifugal separator to separate out finer solid particles. The separated solids are routed to a solids box 30 for disposal.

Heavier hydrocarbons are pumped from the separator 29 via pump 31 and valve 32 into a recovered oil tank 33. The light hydrocarbons and diluent are pumped via pump 31 and valve 34 into the diluent storage tank 35 where the y may be recycled in the tank cleaning process. A pump 36 pumps diluent from the storage tank 35 to a heating vat 37 where it is heated to a temperature approximately 20° F. below its flash point. It is then pumped via a pump 40 and the umbilical hose 41 and 18 to the cannon nozzle 13 as previously described.

Figure 2:
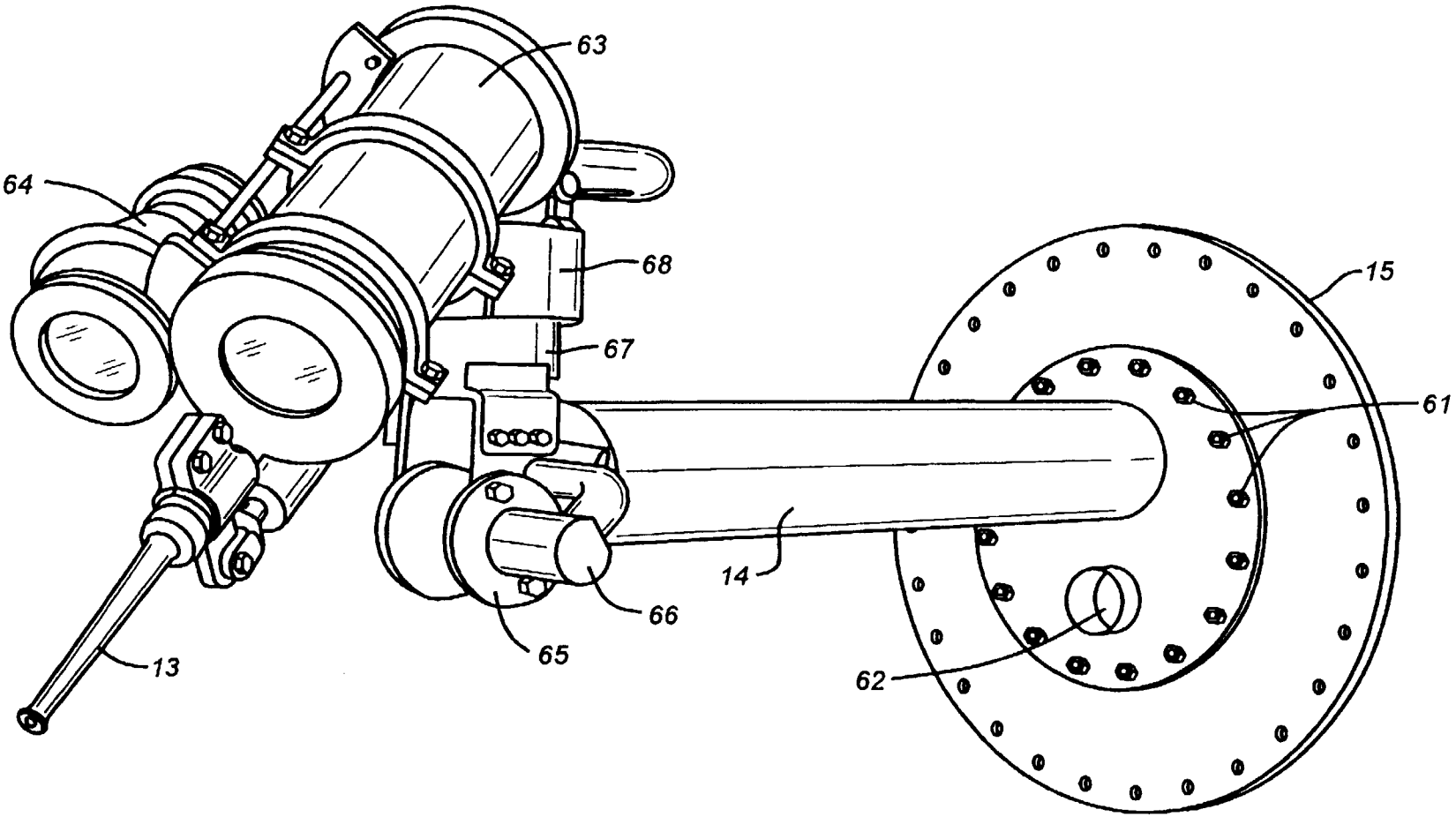
FIG. 2 is a schematic perspective view of the nozzle or cannon assembly cantilever mounted on a manway coverplate.
Figure 3:
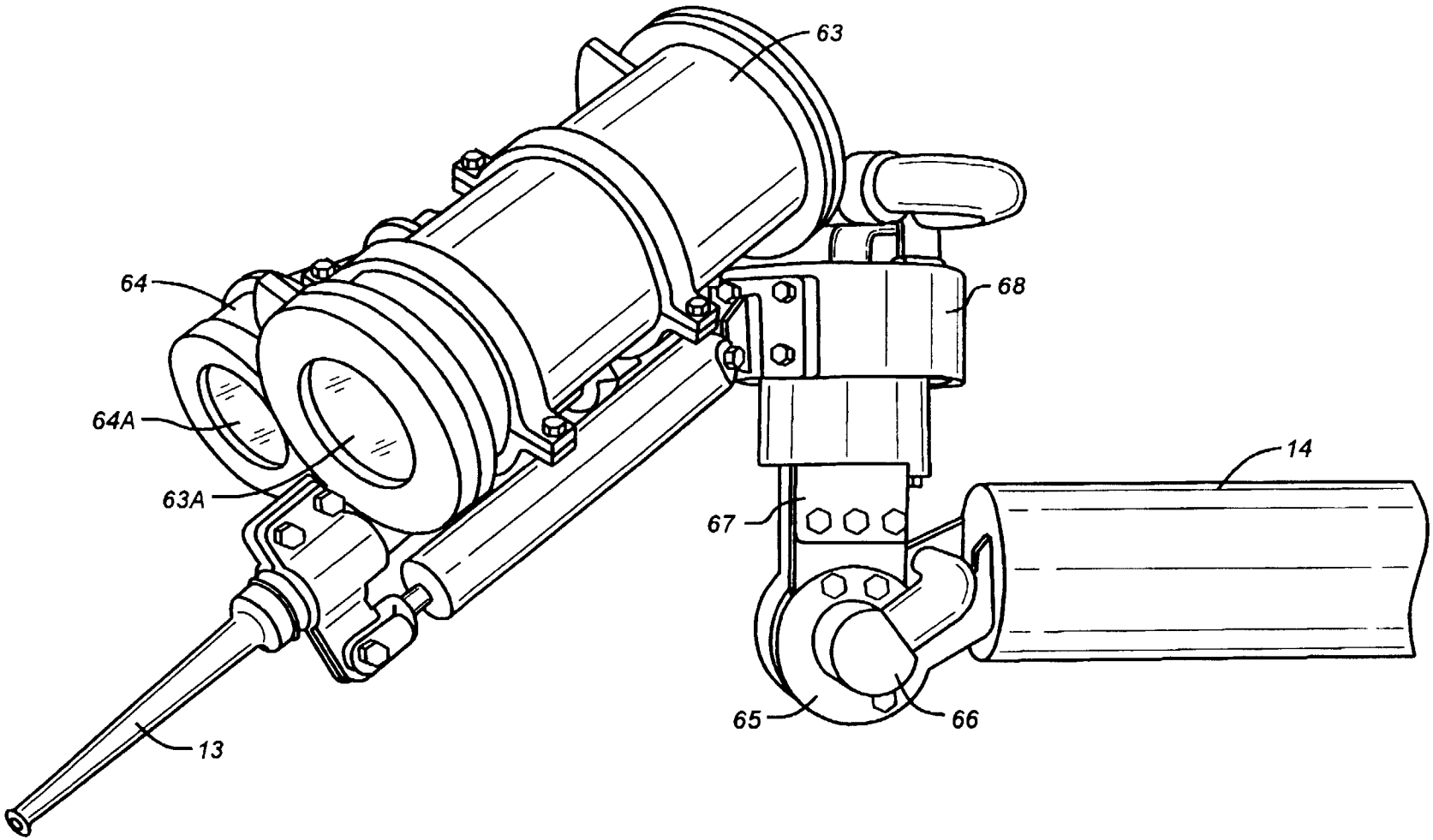
FIG. 3 is a schematic side view of the nozzle or cannon system FIG. 2 showing its articulation joints in more detail.

Referring now to FIGS. 2 and 3 the cannon nozzle system shown generally 12 in FIG. 1 is shown in perspective views from two different angles. Cantilever arm 14 is attached to manway cover hatch 15 which may be affixed to the side of the tank 11 by bolts 61 or the like. The cantilever beam 14 is hollow, and houses the various umbilical electrical cables, hydraulic, and diluent hoses 17, 18, 19 or the like shown schematically in FIG. 1. A port 62 is provided in cover 15 for the evacuation hose 17, 21 of FIG. 1 which passes therethrough and goes to the bottom of tank 11.

A sealed housing 63 contains a video camera. A second sealed hosing 64 contains a light source and is also mounted axially with the cannon nozzle 13. A first hydraulically powered gimbal or pivot 65 allows the arm 67 to pivot on axis 66 under remote control of the operator a console 22. A second hydraulically powered gimbal or pivot 68 is mounted to arm 67 and allows full 360 degree rotation of the cannon nozzle 13 light, camera assembly 63, 64 about the axis of arm 67.

Figure 4:
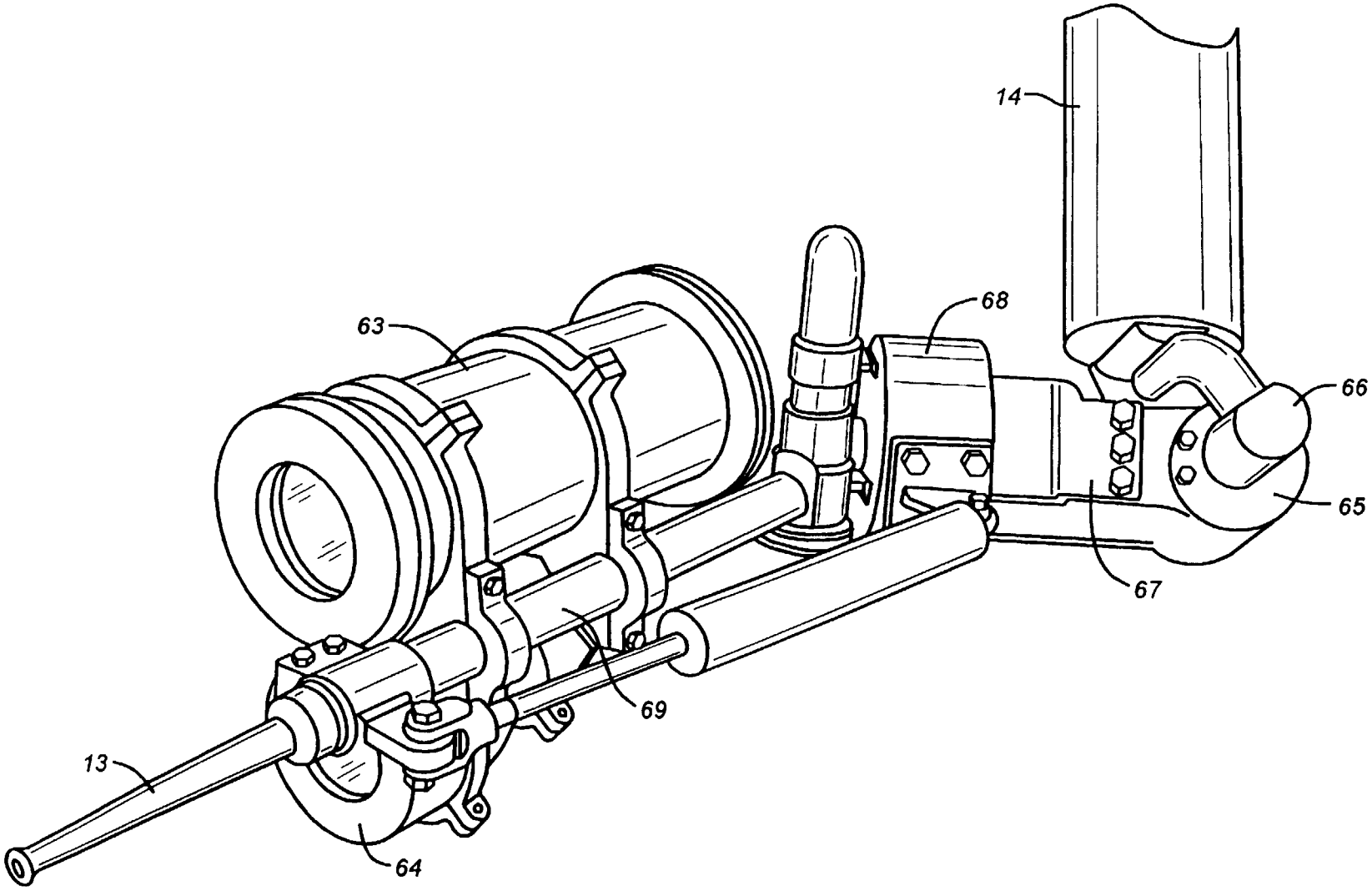
FIG. 4 is a schematic view of the robotic cannon/nozzle system shown suspended from a ceiling manway or port in a tank to be cleaned.

The delivery of the diluent via nozzle 13 is monitored by video camera housed in housing 63, 64 and light source which housings are fixedly strapped to the supply pipe 69 (FIG. 4). Thus the camera housing 63 always tracks and points in the general direction of the nozzle 13 and the effect of the delivered diluent on the sludge may be viewed by the operator. A microphone on the camera can provide audio monitoring of diluent delivery to the operator, if desired.

This heated diluent is provided at relatively low pressure of a few hundred PSI, the object being to break up the solid sludge and to form a pumpable slurry with it which is then picked up and pumped away via evacuation nozzle 17A. If water usage is contemplated rather than diluent, the system 12 and nozzle 13 are fully capable of handing higher pressures for fluid delivery if desired.

Figure 5:
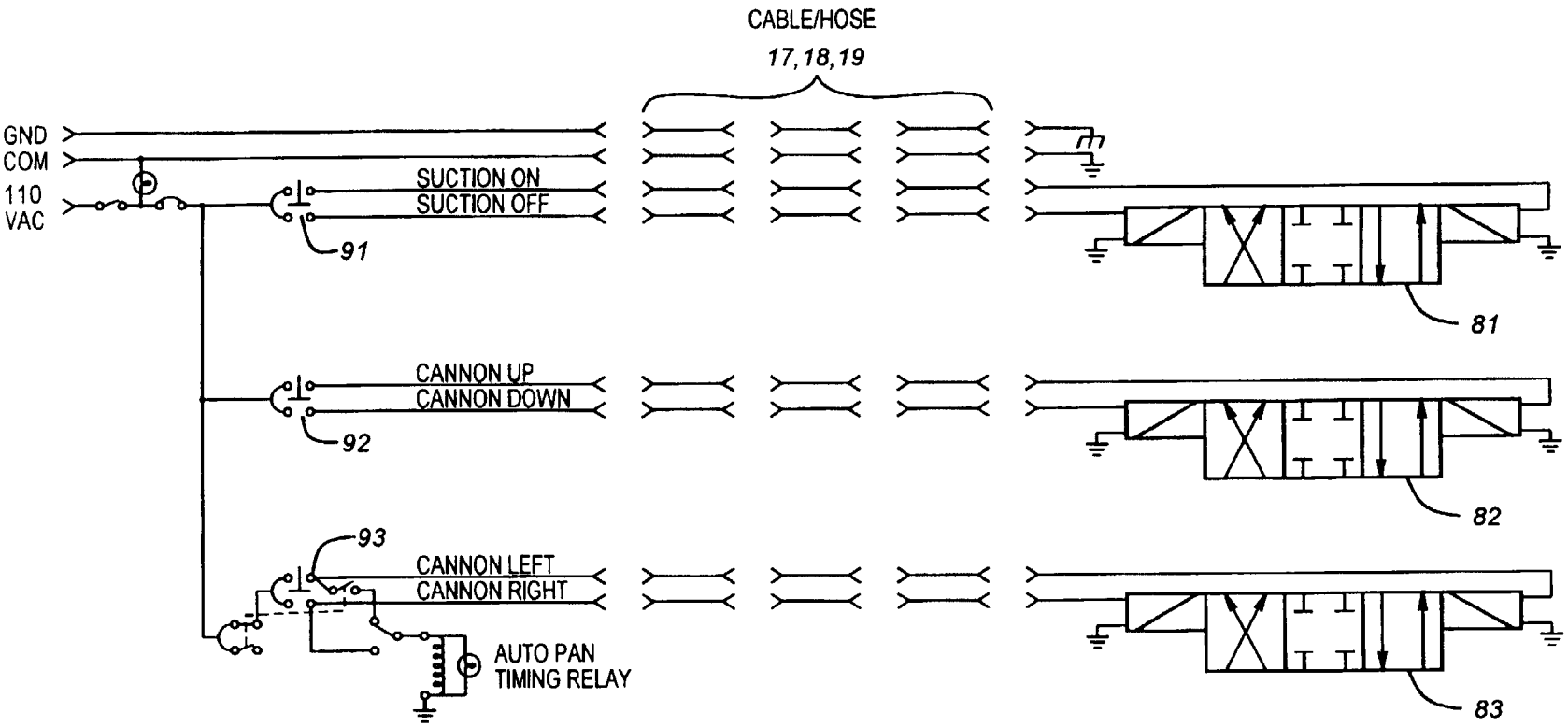
FIG. 5 is a schematic hydraulic and wiring diagram of a portion of the system shown in FIG. 1 for controlling the cannon nozzle and the slurry evacuation nozzle.
Figure 6:
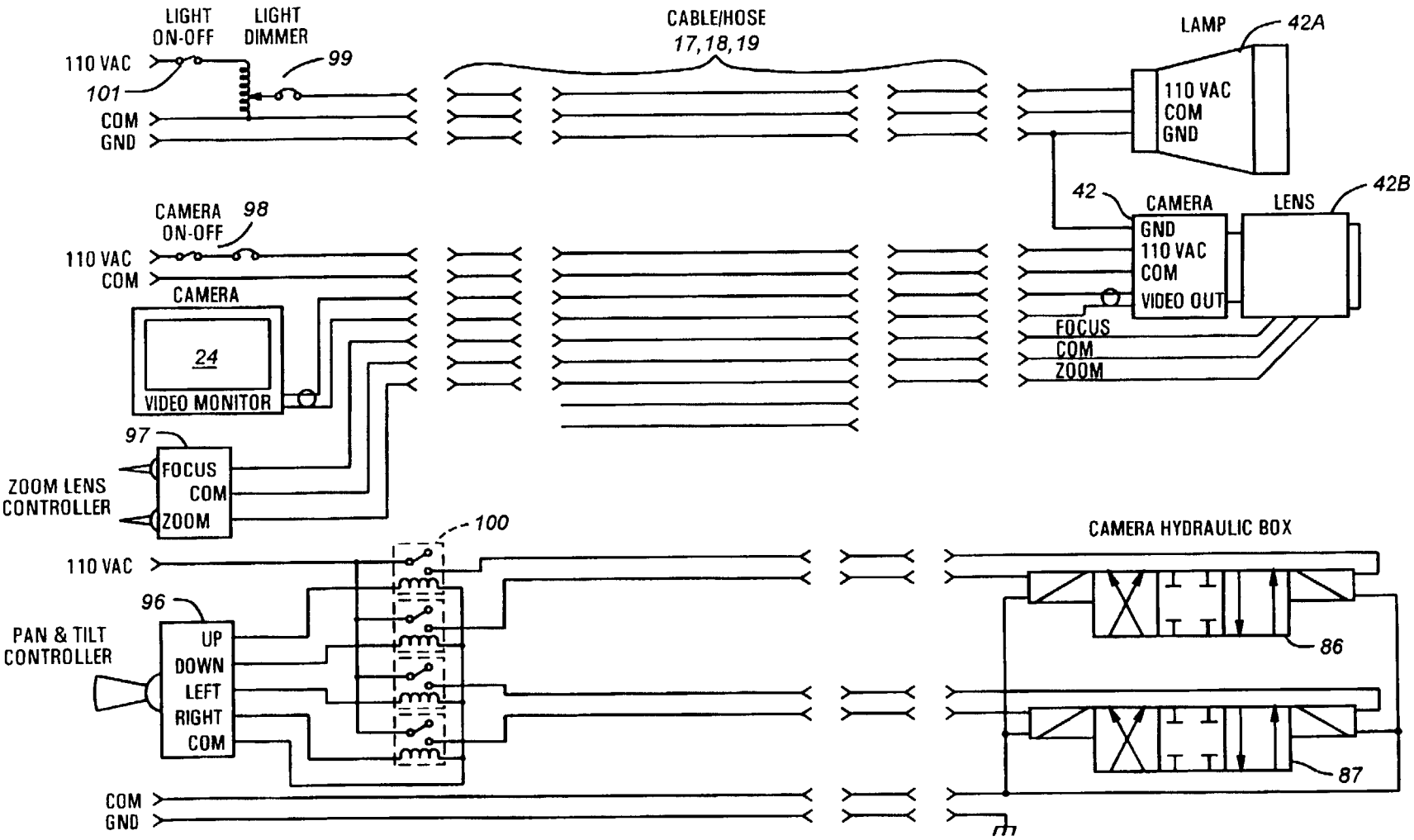
FIG. 6 is a schematic hydraulic and wiring diagram of a separate portion of the system of FIG. 1 for controlling the systems lights and video camera equipment.

Referring now to FIGS. 5 and 6 schematic electrical/hydraulic control diagrams are illustrated. Electric solenoidally activated hydraulic valves 81–83 of FIGS. 5–6 are located in a hydraulic manifold box inside mounting arm 14. This provides an explosion proof system in the event of spark generation. Control switches 91–99 are all mounted on the control console 22 (FIG. 1)and are connected to lamp 64.

For example, control switch 91 on console 22 in one position (up) provides current to solenoid activated hydraulic valve 81 to position a hydraulic activator (not shown) controlling evacuation nozzle 17A to the on position. In its opposite position switch 91 moves nozzle 17A to its off position.

Similarly, switch 92 in one position supplies current to solenoid operated hydraulic valve 82 to move a hydraulic actuator to lower nozzle 13 about it s pivot point. In the opposite position switch 92 moves this actuator and nozzle 13 up similarly operating via hydraulic valve 82 and cable/hose system 17, 18, and 19.

Switch 93 in one position supplies current to solenoid actuated hydraulic valve 83 to move a hydraulic actuator left or tight to direct pivotally mounted nozzle 13 in this manner.

Referring to FIG. 6 a pan an tilt controller joystick 96 is connected to a set of relays 100 in such a manner that relays 100 supply current to solenoid operated hydraulic valves 86 and 87 via cable/hose 18, 17 to drive a pair of hydraulic actuators which can move the video camera housed in housing 63 about its vertical and longitudinal axes. This enables adjustment in the viewing angle of the camera in housing 65.

A zoom lens controller switch 97 supplies signals to zoom lens 42B on camera 42 via cable/hose 17, 18 to cause the zoom lens 42B to change its magnification factor. Thus the monitoring of the effect of diluent or water from nozzle 13 may be monitored at different magnification as desired. A camera on/off control 98 is similarly connected via cable/hose 18, 19 to the camera 42 (FIG. 1). Lens washer systems for the lenses of the light of camera 42A and 42B are supplied which direct clear water across these lenses to wash away any accumulation of debris which could obscure their view. The lens washers are switch controlled from the control panel 25 (FIG. 1).

A light on/off control 101 and dimmer variac 99 in console 22 connected via cable/hose 18, 17 (FIG. 1) to control the brightness of light source 42A associated with camera 42 in the manner shown in FIG. 6. Optimal brightness level for a given camera magnification factor may thus be controlled.

In operation, the system of the present invention can be operated 24 hours a day using shifts of operators to clean tanks quickly. Jobs that using manned equipment would take months to perform become possible to perform in a matter of merely days. Safety of operation personnel is greatly enhanced. If desired, the control console 22 can be provided with VHS video tape recorders to tape record the view of camera 42. Such tapes can be used for monitor purposes at a later time or for the training of operators in the use of the system.

As previously discussed, the described apparatus when properly employed according to the methods of the present invention can provide a GAS TIGHT™ system for tank cleaning. Volatile organic compounds (VOC's) emissions are tightly controlled by state and federal laws. It is important in tank cleaning to provide methods which minimalize the emission of VOC's to within safe and legal bounds. It is apparent from the foregoing discussion that unless proper techniques are used in the deployment of the described hardware system, that VOC's could be improperly vented in setting up the cannon nozzle tank cleaning system. The following description describes method steps which may be employed in setting up the system which will satisfy the most stringent requirements for venting VOC's.

In the methods of the present invention the cantilevered cannon/nozzle system is introduced to the tank to be cleaned through a covered manway in the side or top of the tank. Residue in the tank may comprise undesirably high levels of VOC's. If the manway opening is exposed to the atmosphere for any significant length of time, illegal undesirable VOC emissions could occur. In order to prevent this, once the manway cover is unbolted from the tank a 10 millimeter thick visqueen or polyethylene plastic seal is placed over the opening of the manway to seal off this opening and prevent vapor from escaping the tank. This is performed as fast as possible, but in no instance in greater than 10 seconds from opening the cover.

The previously described system (which will now be referred to as the GT™ system) is positioned in front of the manway and is then inserted through the plastic seal until the face of its mounting flange (15 of FIG. 2) meets flush with the tank whereupon it is bolted in place. This again seals the tank and provides (via sampler 17A and hose 17 of FIG. 1) a means for sampling the atmosphere inside the tank. An air sample is then drawn from the tank and analyzed (on a gas chromatograph) to establish a VOC baseline.

Once the VOC baseline is established (ethylene, benzene, ethyl benzene, etc.), the spraying of diluent at 225 PSI to 300 PSI at 150 to 275 gallons per minute (GPM) is begun to flush as much of the VOC material from the tank as possible. Removal of tank held compounds is via nozzle 17A and hose 17 of FIG. 1.

When as much tank residue is removed by this technique as practical, a appropriate misting solution such as diesel fluid, which would be used in the case of VOC's, at 175 to 275 PSI is sprayed into the tank and recirculated until a good diesel fog (as visually verified) has developed inside the tank atmosphere. Spraying of diesel is then stopped and the diesel mist allowed to settle. This permits the diesel spray to act as a sponge and remove gaseous airborne VOC's in the tank. The VOC level is again monitored and the diesel spray step repeated if necessary.

The diesel is then flushed from the tank by spraying a water and surfactant mixture into the tank and recirculating this spray until a water and surfactant mist is created inside the tank. The VOC content of tank atmosphere is then again measured. If the desired reduction from baseline (usually a 90% reduction is legally required) has been obtained, the internal tank atmosphere can be vented into the earth's atmosphere. If the desired level of reduction has not been obtained, then the diesel spray and water and surfactant spray steps are repeated until the desired level of VOC reduction with respect to baseline has been achieved.

The foregoing descriptions may render changes and modifications to the system obvious to those of skill in the art. The aim of appended claims is to cover all such modifications as fall within the true spirit and scope of the invention.

We claim:

1. A method for gas tight cleaning of industrial tanks which prevents significant outside venting of the tanks' atmosphere until a safe and legal volatile organic compound (VOC) level is obtained, comprising the steps of:

(a) removing a manway cover on the top or side of the tank and immediately installing a flexible seal material over the manway opening to temporarily prevent significant venting of the tank atmosphere to the outside;

(b) positioning a tank cleaning robot system in front of the manway opening and inserting said system through said flexible seal material into the tank interior, said system having a visual monitor, a directable fluid spray nozzle and on evacuation hose, and sealedly attaching said system to said manway opening;

(c) sampling the internal atmosphere of said tank and analyzing the sample for VOC to establish a VOC baseline;

(d) spraying a diluent at relatively high pressure and volume on the interior of the tank to flush away as much material capable of generating VOC's and removing such material from the tank;

(e) spraying diesel fuel at a relatively lower pressure and volume into the tank to create a diesel fog in the tank and allowing the diesel fog to settle, thereby absorbing airborne VOC's;

(f) spraying a water and surfactant mixture into the tank to create a water mist in the tank atmosphere and allowing the water mist to settle;

(g) monitoring the VOC level in the tank and if necessary, repeating steps (e) and (f) to lower the VOC level to a safe and legal percentage of baseline.

2. The method of claim 1 wherein the spraying steps (d), (e) and (f) are visually monitored by a closed circuit television system carried by said tank cleaning robot system.

3. The method of claim 1 wherein the flexible seal material used to temporarily seal the manway opening is placed within 10 seconds of initial tank manway opening.

4. The method of claim 3 wherein the flexible seal material comprises an approximately 10 millimeter sheet of polyethylene plastic.

5. The method of claim 1 wherein the spraying step (d) of diluent is performed at approximately 225 to 300 pounds per square inch pressure at a rate of approximately 150 to 275 gallons per minute.

6. The method of claim 1 wherein the step (e) of diesel spraying is performed at 175 to 275 pounds per square inch pressure.

7. The method of claim 1 wherein the step (f) of water and surfactant spraying is performed at 175 to 275 pounds per square inch pressure.

8. The method of claim 1 wherein steps (e) and (f) are performed a sufficient number of times to lower the VOC level to 10% or less of the original VOC baseline value.

* * * * *